US008347954B2

(12) United States Patent
Amies et al.

(10) Patent No.: US 8,347,954 B2
(45) Date of Patent: Jan. 8, 2013

(54) PLUNGER LIFT SYSTEM WITH SEAL AND BALL DETENT ARRANGEMENT

(75) Inventors: Ryan Amies, Calgary (CA); Grant George, Calgary (CA); Jordan James, Edmonton (CA); Geoff Steele, Calgary (CA)

(73) Assignee: Stellarton Technologies Inc., Calgary, Alberta (CA)

( * ) Notice: Subject to any disclaimer, the term of this patent is extended or adjusted under 35 U.S.C. 154(b) by 710 days.

(21) Appl. No.: 12/027,062

(22) Filed: Feb. 6, 2008

(65) Prior Publication Data

US 2008/0185141 A1 Aug. 7, 2008

Related U.S. Application Data

(60) Provisional application No. 60/888,443, filed on Feb. 6, 2007.

(51) Int. Cl.
*F04B 47/12* (2006.01)
*E21B 43/00* (2006.01)

(52) U.S. Cl. ..... 166/105; 166/68.5; 417/58; 417/60

(58) Field of Classification Search ..... 417/56, 417/59, 60; 166/105, 372, 68.5; 137/624.27
See application file for complete search history.

(56) References Cited

U.S. PATENT DOCUMENTS

| | | | | |
|---|---|---|---|---|
| 2,267,902 | A * | 12/1941 | Eddins | 417/60 |
| 2,878,754 | A * | 3/1959 | McMurry | 417/60 |
| 2,937,598 | A * | 5/1960 | Brown | 277/328 |
| 3,020,852 | A * | 2/1962 | Roach et al. | 417/513 |
| 3,592,222 | A * | 7/1971 | Goss et al. | 137/467 |
| 4,239,458 | A * | 12/1980 | Yeatts | 417/60 |
| 4,531,891 | A * | 7/1985 | Coles, III | 417/59 |
| 6,554,580 | B1 * | 4/2003 | Mayfield et al. | 417/56 |
| 6,644,399 | B2 * | 11/2003 | Abbott et al. | 166/68 |
| 7,021,387 | B2 * | 4/2006 | Lee | 166/372 |
| 7,121,335 | B2 * | 10/2006 | Townsend | 166/105 |
| 7,188,670 | B2 * | 3/2007 | Amies et al. | 166/105 |
| 2003/0215337 | A1 | 11/2003 | Lee | |
| 2006/0065390 | A1 * | 3/2006 | Amies et al. | 166/105 |

* cited by examiner

*Primary Examiner* — Devon Kramer
*Assistant Examiner* — Nathan Zollinger
(74) *Attorney, Agent, or Firm* — Bennett Jones LLP

(57) ABSTRACT

An intermittent lift plunger includes at least one seal mandrel, a bottom sub and an upper valve assembly. The valve assembly is closed by a well bottom stop which inserts into the lift plunger and opened by a lubricator stop at the top of the well. The seal mandrel includes a sleeve seal formed from an elastomeric rubber or plastic, which inflates to engage the well bore surface when the valve is closed and a pressure differential exists.

10 Claims, 5 Drawing Sheets

PLUNGER LIFT SYSTEM WITH SEAL AND BALL DETENT ARRANGEMENT

FIELD OF THE INVENTION

The present invention relates to a plunger lift system for intermittently lifting well fluids in an oil and gas well to the surface.

BACKGROUND

Conventional pump systems for delivery of a fluid from a well bore include pump jacks or positive cavity pumps. While these pump systems have achieved extensive use, they suffer from many disadvantages. One disadvantage is that these systems are expensive. This is particularly problematic for wells with low delivery rates as the cost of the equipment may be difficult to justify. Further, these systems require the use of external power or fuel, which requires the delivery of power or fuel to the well site. Again, the cost of providing power to a well having low delivery rate may be difficult to justify, particularly in remote well locations.

Differential gas pressure operated pistons, also known as plungers, have been used in producing subterranean wells where the natural well pressure is insufficient to produce a free flow of gas, and especially liquids, to the well surface. A completed well typically includes tubulars placed inside the well conduit, which extend from the reservoir of the well to the surface. The cylindrical plunger typically travels within the tubulars between the bottom well stop and the top of the tubulars, where a well valve and a lubricator are positioned. A spring is typically included inside the lubricator assembly to absorb the impact energy of the plunger when it reaches the surface. The well is shut in for a selected time period which allows downhole pressure to build up, then the well is opened for a selected period of time. When the well valve is opened, the plunger is able to move up the tubulars, pushing a liquid slug to the well surface. When the well valve is later closed, the plunger, aided by gravity, falls downwardly to the bottom of the tubulars. Typically, the open and closed times for the well valve are managed by a programmable electronic controller.

When the plunger is functioning properly, fluids accumulate and stay above the plunger and pressurized gases and/or fluids below the plunger are blocked from flowing up, around, and through the plunger. As a result, the plunger and accumulated fluids are pushed upwardly. The prior art devices use a variety of external, and sometimes internal, sealing elements which allow the plungers to block the upward flow of gases and to slidingly and sealably engage the tubulars, which accomplishes the lifting of fluids to the surface depending upon the variable well pressures.

Improvements of this technology may permit economic operation of wells which were previously uneconomic. Therefore, there is a continuing need in the art for improved plunger systems which obviate or mitigate disadvantages in the prior art.

SUMMARY OF THE INVENTION

The present invention comprises a plunger for intermittently lifting fluids from a well having a bottom well stop means. The plunger has an upper end and a lower end and defines an internal chamber, and comprises:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings;

(c) a valve assembly disposed at one end of the plunger, comprising a valve body defining a valve opening, a valve stem wherein the valve is slidingly disposed within the valve body, and is moveable between a first position wherein the valve opening is closed and a second position wherein the valve opening is open; and (d) means for maintaining the valve in an open position, and means for maintaining the valve in a closed position, wherein the force required to overcome the open position means, thereby closing the valve, is less than the force required to overcome the closed position means, thereby opening the valve.

In another aspect, the invention may comprise a plunger comprising:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings, wherein said seal sleeve has a middle portion bounded by an upper portion and a lower portion, wherein the middle portion is more pliable than one or both of the upper portion and lower portion;

(c) a valve assembly disposed at one end of the plunger, comprising a valve body defining a valve opening, a valve stem wherein the valve is slidingly disposed within the valve body, and is moveable between a first position wherein the valve opening is closed and a second position wherein the valve opening is open.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

Figure 1:
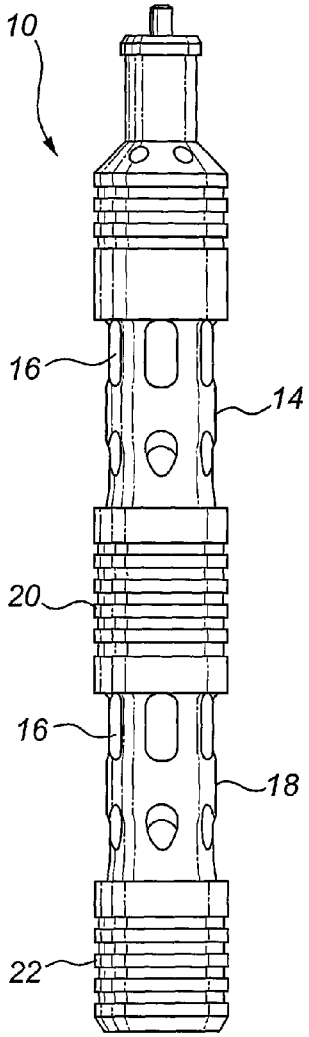
FIG. 1 is a side view of one embodiment of the present invention, without the seal sleeves in place.
Figure 2:
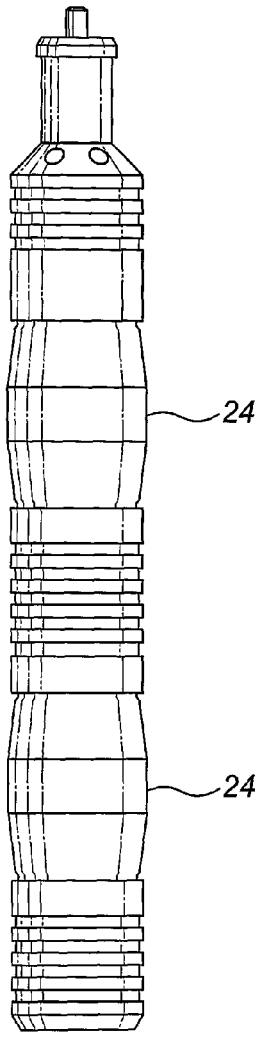
FIG. 2 is a side view of one embodiment with the seal sleeves in place.

The present invention provides for an intermittent plunger. When describing the present invention, all terms not defined herein have their common art-recognized meanings. The plunger (10) will be described with regard to its typical orientation in use, such that longitudinal axis of the cylindrical plunger is substantially vertical. Therefore, the terms "lateral", "radial" or "horizontal" shall refer to a direction or plane substantially perpendicular to the longitudinal vertical axis of the plunger (10).

The plunger (10) shown in the Figures is of the general type of plungers operated by differential gas pressure, as is well known in the art. In one embodiment, the plunger (10) defines a central and elongate internal chamber and includes a valve assembly (12), a first seal mandrel (14) defining a plurality of seal openings (16), a second seal mandrel (18) also defining a plurality of seal openings, and a coupler (20) for joining the two seal mandrels together. A bottom sub (22) is attached to the lower end of the second seal mandrel (18). The various components of the plunger (10) are threadingly engaged as is well known in the art.

Figure 3:
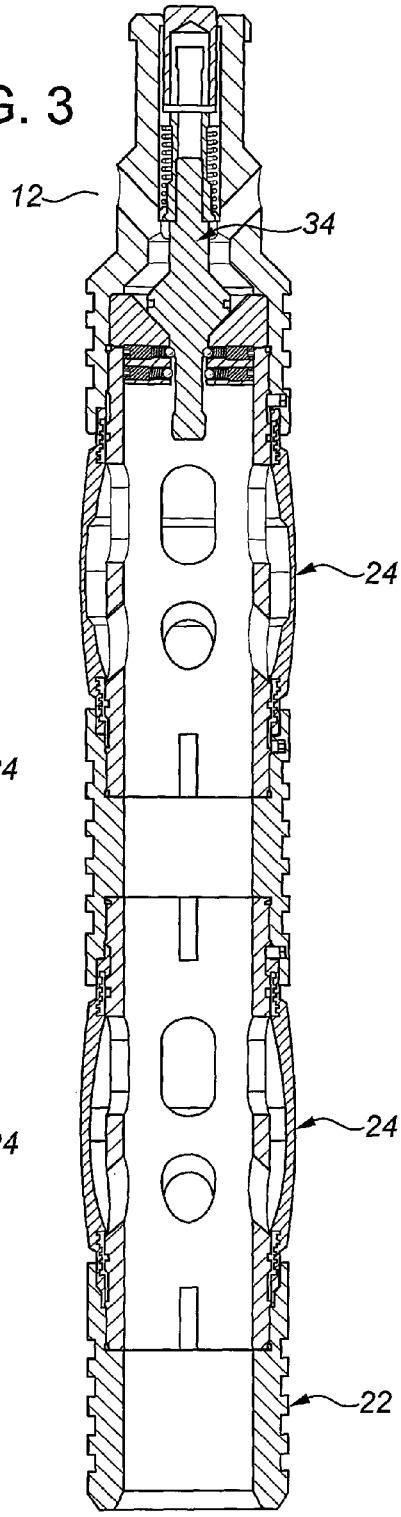
FIG. 3 is a longitudinal cross-sectional view of FIG. 2.

The plunger illustrated in FIG. 3 shows a valve assembly (12) at the top end of the plunger (10). The present invention may be implemented with the valve assembly at the top or bottom of the plunger, and the orientation of the elements described may be varied by those skilled in the art as necessary.

The seal mandrels (14, 18) each include a resilient seal (24) which covers the seal openings (16). In a preferred embodiment, the seal (24) is a sleeve made of an elastomeric material such as natural or synthetic rubber, or an elastomeric polymer. A lock ring (25) preferably made of metal attaches each end of the sleeve to the seal mandrel (14,18). As will be apparent to those skilled in the art, if the valve assembly (12) is closed, a pressure differential between the internal chamber of the plunger and the exterior will cause the seals (24) to expand outwards. When the pressure equalizes, the seals will retract.

Figure 4:
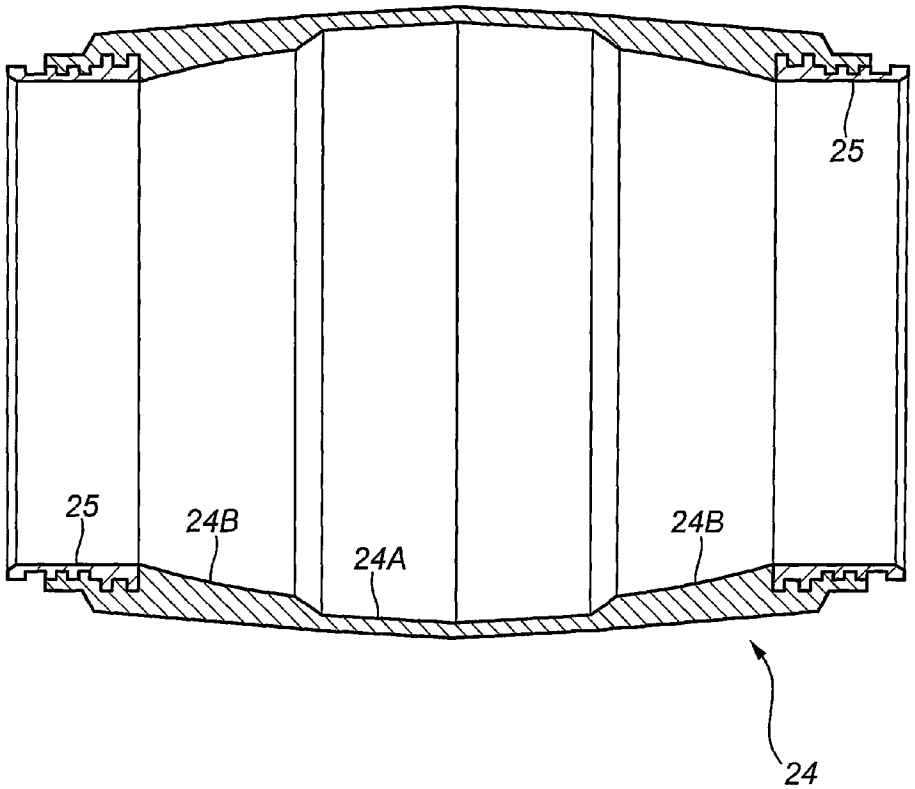
FIG. 4 is a cross-sectional view of one embodiment of a seal sleeve.
Figure 5:
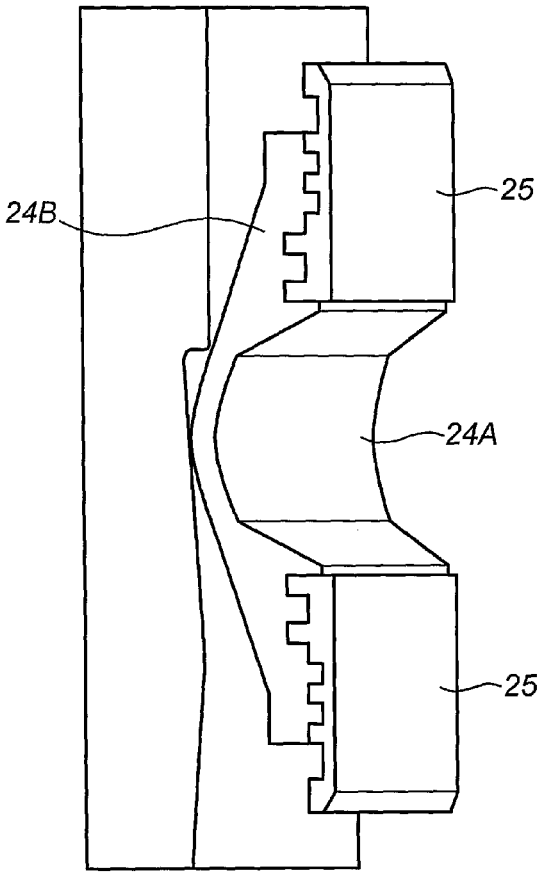
FIG. 5 shows an expanded seal in contact with a tubular wall.

As shown in FIG. 4, the wall of the seal (24) has a profile affecting its expanded shape so as to reduce or minimize friction between the seal (24) and tubulars in the well conduits while maintaining the integrity of the seal. As shown in FIG. 4, the seal wall comprises a middle portion (24A) which is more pliable than the outer portions (24B) which are adjacent the lock rings (25). In one embodiment, the middle portion is more pliable because it has a thinner wall. In one alternative embodiment, the middle portion may be made from a different material which is more pliable than the outer portions (24B). When inflated by a pressure differential, as shown in FIG. 5, the middle portion contacts the tubular wall, effecting the seal. Because the middle portion is more pliable, a better seal with the tubular is achieved. In one embodiment, the middle portion of the seal is configured to always be in contact with the casing, in an interference design, or very close to being in contact with the casing. As a result, differential pressure within the seal will energize the seal. In this design, a greater portion of the energy generated in the wellbore is used in lifting the plunger and associated fluids.

Figure 6:
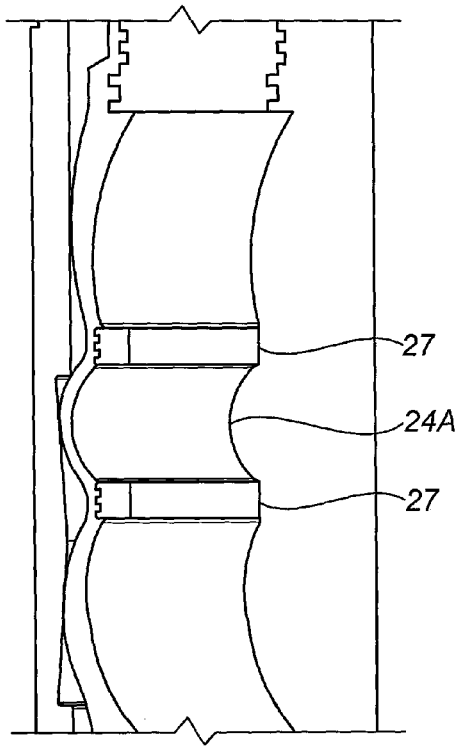
FIG. 6 shows one embodiment of an expanded seal in contact with a tubular wall.

In alternative embodiment, shown in FIG. 6, the middle more pliable portion (24A) of the seal is bounded by rings (27). Three points of contact, above and below the rings (27) and in the pliable middle portion (24A) provide the seal with the tubular wall.

Figure 7:
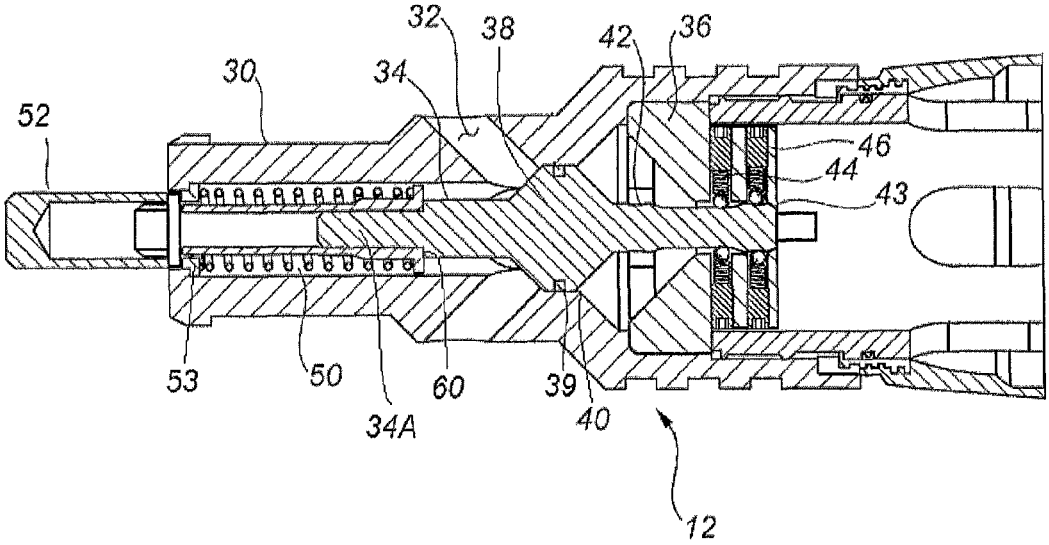
FIG. 7 is a detailed cross-sectional view of the valve assembly shown in FIG. 3, with the valve in the closed position.

As may be seen in FIG. 7, the valve assembly (12) comprises a valve body (30) having a plurality of valve openings (32) which radiate outwards at an inclined angle from a central fluid passageway. A valve stem (34) having a valve (38) is supported laterally by a valve retainer (36) at its lower end and by the valve actuator assembly (50) at its upper end. The valve stem (34) protrudes into the internal chamber when the valve stem is in a lowered position, where the valve is open. When the valve stem is raised, the valve (38) itself rests against the valve seat (40) to close the valve openings, the position shown in FIG. 7.

The valve (38) may include an O-ring seal or a similar seal (39) which improves the seal between the valve (38) and the valve seat (40). The valve seat (40) comprises a narrowed portion of the internal passageway of the valve body (30). The space below the valve (38) is configured to allow the valve (38) to be lowered, without blocking the fluid passageways created by the valve retainer (36) and the valve body (30). Thus, when the valve (38) is lowered, the valve opens as shown in FIG. 3.

Figure 8:
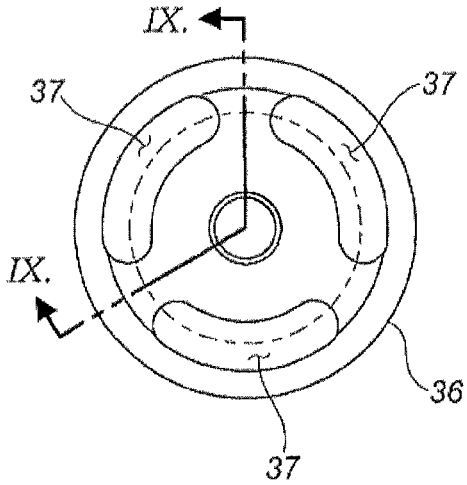
FIG. 8 is a top plan view of a valve retainer.
Figure 9:
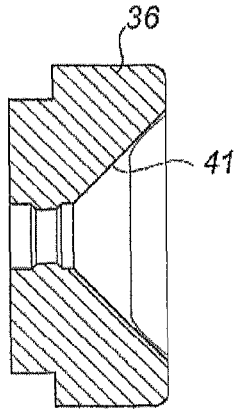
FIG. 9 is a cross-sectional view of a valve retainer, along line IX-IX in FIG. 8.
Figure 10:
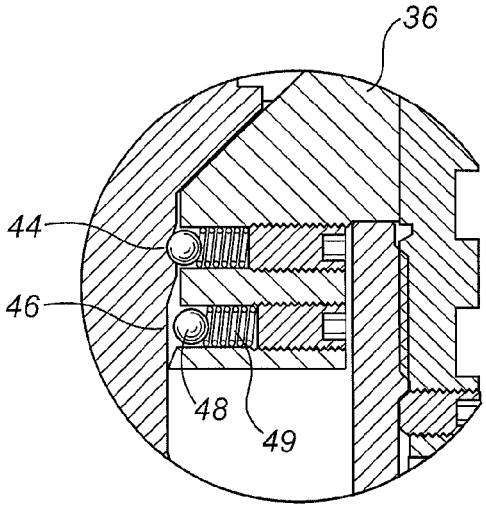
FIG. 10 is a detailed view of a portion of FIG. 3, showing the upper and lower ball detent systems.

The valve retainer (36), as shown in FIGS. 8 and 9, centralizes the valve stem (34) within the valve body (30). The valve retainer (36) defines a cone-shaped valve seat (41) which receives the lower end of the valve (38), when the valve is in a lowered, open position. The valve retainer (36) further defines a plurality of openings (37) permitting fluid flow through the valve retainer (36) and around the valve (38). The valve retainer (36) includes an upper ball detent system (44) and a lower ball detent system (46) shown in FIG. 7, and in detail in FIG. 10.

In one embodiment, the lower portion of the valve stem (34) comprises an open detent profile (42) and a close detent profile (43), each of which cooperates with a upper ball detent system (44) and a lower ball detent system (46) respectively, to maintain the valve in either the open or closed position. Each of the upper and lower ball detent systems (44, 46) includes a ball (48) which is radially biased inwards by a spring (49) within a lateral opening in the valve retainer (36). The spring and ball are retained by a set screw. When the valve (38) is in its open position, the balls (48) of the upper ball detent system (44) engage the open detent profile (42), thereby maintaining the valve (38) in the open position as shown in detail in FIG. 10.

As shown in FIG. 7, when the valve (38) is in its closed position, the balls (48) of the lower ball detent system (46) engage the closed detent profile (43), thereby maintaining the valve (38) in the closed position.

Figure 11:
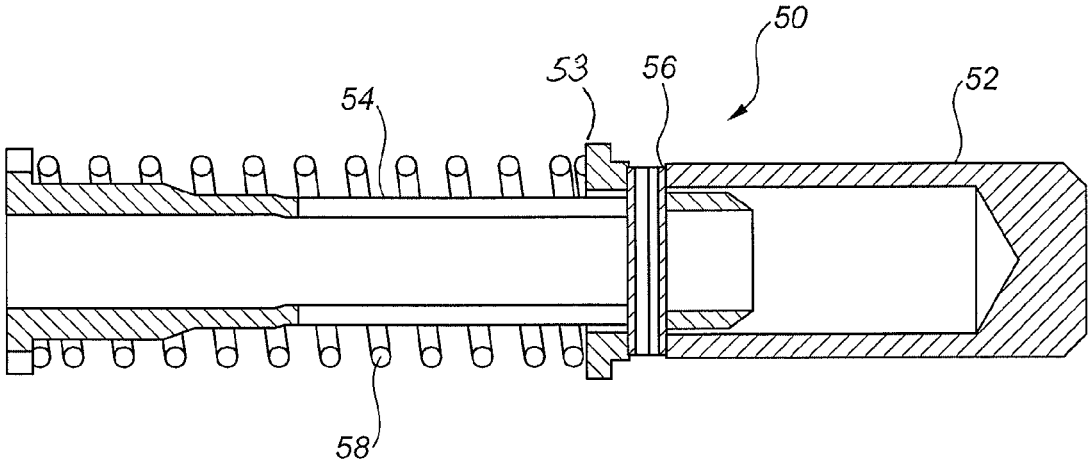
FIG. 11 is a detailed view of the valve actuator assembly.

In one embodiment, the force required to close the valve by overcoming the upper detent system (46) is less than the force required to open the valve by overcoming the lower detent system (44). Accordingly, the upward force on the valve stem required to close the valve from its open position is reduced, relative to the downward force on the valve stem required to disengage the valve from its closed position. If the plunger (10) encounters fluid in the wellbore during its descent, it may not land with sufficient force to close the valve. By lowering the force necessary to close the valve, the probability of closing the valve may be increased significantly. The force required to overcome the detent systems may be varied by adjusting the strength of the springs which bias the detent balls inwards, or by varying the number of detent balls used. In one embodiment, shown in FIG. 11, the valve actuator assembly (50) comprises an actuating sleeve (52) which slidingly engages a limiting sleeve (54) and are fixed together by a spring pin (56). The pin (56) slides within slots in the limiting sleeve (54), and limits excessive travel. A valve spring (58) may be compressed between a bearing surface on the lower portion of the actuating sleeve (52) and a bearing surface on the limiting sleeve (54). The actuator (50) fits within the internal chamber of the valve body (30). Protuberances (53) on the lower portion of the actuating sleeve (52) prevent the actuator (50) from moving upwards out of the valve body (30).

The top portion (34A) of the valve stem (34) engages the limiting sleeve (54) by protruding into the inner bore of the limiting sleeve. The valve stem defines a shoulder (60) which bears on the bottom of the limiting sleeve (54), which is thereby prevented from moving downwards, relative to the valve stem (34).

The valve spring (58) thus acts between the actuating sleeve (52) and the valve stem (34). When the valve is in its open position, as shown in FIG. 3, the spring (58) is relaxed and the actuating sleeve (52) is retracted into the valve body. In the open position, the actuator (50) will float freely inside the valve body (30) between the valve stem shoulder (60) and the internal valve body shoulder. When the valve stem (34) is raised and the valve is closed, the valve stem (34) urges the actuator (50) upwards and the spring remains uncompressed. When the actuating sleeve (52) makes contact with the valve stop at the top of the wellbore and the plunger is urged upwards by well pressure, the spring (58) will compress until the spring force on the valve stem (34) exceeds the detent force of the lower detent system (46). The spring will then fully open the valve in one motion.

The exterior surface of the valve body (30) may be configured as a fish neck, to facilitate retrieval of the plunger by a fishing tool.

In operation, the plunger (10) is placed in a well bore with the valve (12) in an open position. The plunger falls down the well bore. Fluids within the internal chamber pass through the open valve. The valve actuator assembly (50) floats freely inside the valve chamber (30). The incidental motion of the valve actuator assembly prevents debris from accumulating within or adhering to the interior walls of the valve chamber (30). Upon reaching the well bottom, or the depth where a well stop means is positioned, the lower end of the valve stem (34) contacts the well stop means, causing the valve to overcome the upper ball detent system (44) which engages the open detent profile (42) and move upwards into its closed position. The well stop means is stationary within the well bore and includes a downhole anchor (not shown) and a valve actuating member (not shown) which inserts into the internal chamber and bears on the lower end (34) of the valve stem. The well stop means may have any configuration which includes a valve actuating member which inserts into the internal chamber of the plunger (10), or which contacts the plunger to close the valve. The present invention is not limited by any specific configuration of the well stop means.

Once the valve (12) closes, fluid pressure will begin to rise within the plunger internal chamber, causing the seals (24) to expand outward. Once the seals (24) expand to contact the well bore surface, fluids will not be able to rise above the plunger (10) and the rate of change of the pressure differential will accelerate. Eventually, the pressure underneath the plunger will overcome any frictional resistance of the seals against the well bore surface and the hydrostatic force of the fluid column above the plunger, and cause the plunger to rise. Any fluids above the plunger will thus be lifted to the surface.

Upon reaching the surface, a well stop (not shown) impacts the actuator sleeve (52). The pressure underneath the plunger causes the valve body (30) to slide upwards relative to the actuator sleeve (52), compressing the spring (58). As the spring (58) compresses, it transfers increasing compressive force to the limiting sleeve (54) which in turn transfers increasing compressive force to the valve stem (34). When the compressive force is sufficiently large to overcome the resistance provided by the lower ball detent system, the valve actuator system (50) disengages the valve (38) from the closed position and snaps the valve (34) into the open position. The pressure surrounding the valve chamber (30) equalizes. The seals (24) then retract to be relatively flush with the seal mandrel and the cylindrical sides of the plunger (10). The plunger then falls under the force of gravity within the wellbore, reaching the well stop means, where the lift cycle may commence again.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A plunger having an upper end and a lower end, and defining an internal chamber, for intermittently lifting fluids from a well having a bottom well stop means, said plunger comprising:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings;

(c) a valve assembly disposed at one end of the plunger, comprising a valve body defining a valve opening, a valve stem wherein a valve is slidingly disposed within the valve body, and is moveable between a first position wherein the valve opening is closed and a second position wherein the valve opening is open; and (d) an upper ball detent system which cooperates with an upper detent profile formed on the valve stem, and a lower ball detent system which cooperates with a lower detent profile formed on the valve stem, wherein each ball detent system comprises a ball biased in an inward radial direction by a spring, said ball cooperating with the corresponding detent profile to resist vertical movement of the valve stem wherein the force required to overcome the upper ball detent system, thereby closing the valve, is less than the force required to overcome the lower ball detent system, thereby opening the valve.

2. The plunger of claim 1 wherein the resilient seal sleeve comprises a middle portion disposed between an upper portion and a lower portion, wherein the middle portion is more pliable than one or both of the upper and lower portions.

3. The plunger of claim 1 comprising at least two seal mandrels each having a resilient seal sleeve and joined by a coupler.

4. The plunger of claim 1 wherein the valve body has an exterior surface which Functions as a fish neck.

5. The plunger of claim 1 wherein the valve stem is centralized by a valve retainer at a lower end of the valve stem, and by the valve body at an upper end of the valve stem.

6. A plunger having an upper end and a lower end, and defining an internal chamber, for intermittently lifting fluids from a well having a bottom well stop means, said plunger comprising:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings, wherein said seal sleeve has a middle portion bounded by similarly-shaped upper and lower portions, wherein the middle portion is thinner and more pliable than both the upper portion and lower portion;

(c) a valve assembly disposed at one end of the plunger, comprising a valve body defining a valve opening, a valve stem wherein a valve is slidingly disposed within the valve body, and is moveable between a first position wherein the valve opening is closed and a second position wherein the valve opening is open.

7. The plunger of claim 6 wherein the middle portion has an outside diameter closely matching an inside diameter of a tubular within which the plunger travels.

8. The plunger of claim 6 wherein the upper and lower portions of the seal sleeve are symmetrical.

9. A plunger having an upper end and a lower end, and defining an internal chamber, for intermittently lifting fluids from a well having a bottom well stop means, said plunger comprising:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings;

(c) a valve assembly disposed at one end of the plunger, comprising a valve body defining a valve opening, a valve stem wherein a valve is slidingly disposed within the valve body, and is moveable between a first position wherein the valve opening is closed and a second position wherein the valve opening is open; and (d) means for maintaining the valve in an open position, and means for maintaining the valve in a closed position, wherein the force required to overcome the open position means, thereby closing the valve, is less than the force required to overcome the closed position means, thereby opening the valve;

(e) wherein the valve assembly further comprises a valve actuator assembly comprising:

(i) a limiting sleeve disposed within the valve body and which engages an upper end of the valve stem;

(ii) an actuator sleeve which slidingly engages the limiting sleeve within the valve body and is moveable between a first position extending out of the valve body, and a second position retracted within the valve body; and (iii) means for biasing the actuator sleeve away from the valve stem.

10. The plunger of claim 9 wherein the means for biasing the actuator sleeve away from the valve stem comprises a valve spring.

* * * * *